US008679295B2

(12) United States Patent
Druecke et al.

(10) Patent No.: US 8,679,295 B2
(45) Date of Patent: Mar. 25, 2014

(54) SOFT CREPED TISSUE

(75) Inventors: Frank Gerald Druecke, Oshkosh, WI (US); Dave Allen Soerens, Neenah, WI (US); Benjamin Joseph Kruchoski, Appleton, WI (US); Frederick John Lang, Neenah, WI (US); Christopher Lee Satori, Hortonville, WI (US); John Alexander Werner, IV, Hortonville, WI (US); Cathleen Mae Uttecht, Menasha, WI (US); Mickey Joseph Authement, II, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/424,652

(22) Filed: Mar. 20, 2012

(65) Prior Publication Data

US 2012/0255693 A1 Oct. 11, 2012

Related U.S. Application Data

(60) Provisional application No. 61/473,601, filed on Apr. 8, 2011.

(51) Int. Cl.

| | |
|---|---|
| ***B31F 1/12*** | (2006.01) |
| ***D21H 17/07*** | (2006.01) |
| ***D21H 17/29*** | (2006.01) |
| ***D21H 17/44*** | (2006.01) |
| ***D21H 21/14*** | (2006.01) |
| ***D21H 27/02*** | (2006.01) |

(52) U.S. Cl.

CPC *B31F 1/12* (2013.01); *D21H 17/07* (2013.01); *D21H 17/29* (2013.01); *D21H 17/44* (2013.01); *D21H 21/146* (2013.01); *D21H 27/02* (2013.01)

USPC ..... 162/111; 162/123; 162/135; 162/175; 162/179; 162/184; 162/164.1; 428/153

(58) Field of Classification Search

CPC ..... D21H 17/07; D21H 17/29; D21H 17/44; D21H 21/146; D21H 27/02; B31F 1/12

USPC ..... 162/109, 111–113, 135, 158, 164.1, 162/168.1, 175, 177, 179, 183–184, 123; 428/152–153, 195.1, 172

See application file for complete search history.

(56) References Cited

U.S. PATENT DOCUMENTS

| | | | |
|---|---|---|---|
| 3,136,646 | A | 6/1964 | Elizer et al. |
| 3,354,034 | A | 11/1967 | Wadym |

(Continued)

FOREIGN PATENT DOCUMENTS

| | | | |
|---|---|---|---|
| EP | 0 098 148 | A2 | 1/1984 |
| EP | 0 895 554 | A1 | 2/1999 |

(Continued)

OTHER PUBLICATIONS

Co-pending U.S. Appl. No. 13/424,663, filed Mar. 20, 2012, by Druecke et al. for "Soft Creped Tissue Having Slow Wet Out Time."

*Primary Examiner* — Jose Fortuna

(74) *Attorney, Agent, or Firm* — Kimberly-Clark Worldwide, Inc.

(57) ABSTRACT

The present disclosure relates generally to a tissue product having a creping composition disposed onto at least one surface thereof to increase the softness of the article, while retaining or improving manufacturing efficiency. Preferably the creping composition comprises a first component that is cationic and a second component that is capable of forming a film. Preferably both the first and second components are water soluble. The first component carries a cationic charge that is capable of forming ionic bonds with the negatively charged fibers of the tissue web, thus providing a retention mechanism by which the creping composition is retained. The overall retention of the creping composition reduces the concentration of the composition in the machine process water, improving machine operability and runability.

17 Claims, 3 Drawing Sheets

(56) References Cited

U.S. PATENT DOCUMENTS

| | | | | | |
|---|---|---|---|---|---|
| 3,812,000 | A | | 5/1974 | Salvucci, Jr. et al. | |
| 4,196,044 | A | | 4/1980 | Mussoni et al. | |
| 4,501,640 | A | | 2/1985 | Soerens | |
| 5,061,346 | A | | 10/1991 | Taggart et al. | |
| 5,234,547 | A | * | 8/1993 | Knight et al. | 162/111 |
| 5,354,425 | A | * | 10/1994 | Mackey et al. | 162/135 |
| 5,487,813 | A | | 1/1996 | Vinson et al. | |
| 5,536,764 | A | | 7/1996 | Nguyen et al. | |
| 5,635,028 | A | | 6/1997 | Vinson et al. | |
| 5,730,839 | A | * | 3/1998 | Wendt et al. | 162/111 |
| 5,865,950 | A | | 2/1999 | Vinson et al. | |
| 6,207,734 | B1 | | 3/2001 | Vinson | |
| 6,238,519 | B1 | | 5/2001 | Jones et al. | |
| 6,328,849 | B1 | | 12/2001 | Dwiggins et al. | |
| 7,744,722 | B1 | | 6/2010 | Tucker et al. | |
| 8,231,761 | B2 | * | 7/2012 | Boettcher et al. | 162/111 |
| 8,426,031 | B2 | * | 4/2013 | Zwick et al. | 428/532 |
| 2004/0062907 | A1 | | 4/2004 | Lindsay et al. | |
| 2004/0144510 | A1 | | 7/2004 | Mauler | |
| 2005/0006040 | A1 | | 1/2005 | Boettcher et al. | |
| 2006/0207735 | A1 | | 9/2006 | Blanz et al. | |
| 2007/0000630 | A1 | | 1/2007 | Hassler et al. | |
| 2010/0155004 | A1 | | 6/2010 | Soerens et al. | |
| 2012/0164206 | A1 | * | 6/2012 | Soerens et al. | 424/414 |
| 2012/0165775 | A1 | * | 6/2012 | Soerens et al. | 604/372 |
| 2012/0255693 | A1 | * | 10/2012 | Druecke et al. | 162/111 |
| 2012/0255694 | A1 | * | 10/2012 | Druecke et al. | 162/111 |
| 2013/0071655 | A1 | * | 3/2013 | Zwick et al. | 428/340 |

FOREIGN PATENT DOCUMENTS

| | | | | |
|---|---|---|---|---|
| EP | 1 102 896 | A1 | | 5/2001 |
| WO | WO 2012137101 | A2 | * | 10/2012 |
| WO | WO 2012137102 | A2 | * | 10/2012 |

* cited by examiner

SOFT CREPED TISSUE

CROSS REFERENCE TO RELATED APPLICATIONS

This application claims the benefit of U.S. provisional patent application No. 61/473,601, filed Apr. 8, 2012, the disclosure of which is incorporated herein by reference.

BACKGROUND

Absorbent rate, softness, and strength are key properties for a facial tissue. The absorbent rate of a facial tissue affects its performance in capturing sneezes and nose blows. If the absorbent rate is too slow the contents of the exudate may be wiped across the face or transferred to other surfaces. In general, softness and strength are inversely related such that a reduction in strength will produce an increase in softness. There are practical limits to softness improvements from strength reduction before the tissue becomes too weak to use.

Softness can be enhanced by the topical addition of softening agents, such as a silicone emulsion, to the outer surfaces of the fibrous web. However, softening agents and post treatment steps can be expensive, increase manufacturing complexity, and can reduce the absorbent rate and strength of the tissue.

An alternative to surface treatments is the use of creping and creping chemistries to increase tissue softness. One such alternative is described, for example, in U.S. Pat. No. 7,883,604, which discloses increasing tissue softness by creping with a water insoluble dispersion that modifies the surface of the tissue web with a thin, discontinuous polyolefin film. Unfortunately the water insoluble nature of the polyolefin dispersion may negatively impact tissue machine runability and require removal from a mill's waste water system.

An alternative to water insoluble dispersions is described in US Publication No. 2010/0155004, which discloses a water soluble creping chemistry comprising a film forming component and a modifier component. Although these water soluble creping chemistries eliminate many of the tissue machine's operational challenges, their use still requires a removal step to prevent accumulation of the water soluble chemicals in the mill's water system.

As such, a need currently exists for a creping composition that produces a soft tissue, but is also retained on the sheet so as not to negatively impact manufacturing efficiency or require additional waste water treatment.

SUMMARY

It has now been surprisingly discovered that a creping composition comprising a cationic component may be added to a tissue sheet during the creping step of conventional tissue manufacturing to provide a soft tissue product without negatively impacting machine runability. Moreover, the compositions of the present disclosure may be applied at high additional levels, for example the add on rate of creping composition to the dryer, measured as mass (i.e., mg) per unit area of dryer surface (i.e., $m^2$) is preferably greater than about 50 mg/$m^2$. The creping compositions provide the additional benefit of high retention on the sheet, such that the sheet has water soluble extractives less than about 1.0%. As such the creping compositions can be applied to the base sheet in an amount sufficient so as to increase the softness of the sheet, without negatively impacting processing and manufacture of the tissue sheet.

Accordingly, in one aspect the present disclosure provides a creped tissue product comprising a creped tissue web having a fine crepe structure, measured as the coefficient-of-variation (COV) at 0.28-0.55 mm as described in the Test Methods section, of less than about 20% COV, a Fuzz on Edge greater than about 0.95 mm/mm and less than about 0.60 percent water soluble extractives by weight of the tissue web.

In still other aspects the present disclosure provides a creped tissue product comprising a creped tissue web having a first side and a second side; and a creping composition comprising a cationic component disposed on at least the first side; wherein the tissue web has a fine crepe structure less than about 25% COV and less than about 0.50 percent water soluble extractives by weight of the tissue web.

In yet other aspects the present disclosure provides process for producing a sheet product comprising applying a creping composition comprising a cationic component to a moving creping surface at levels greater than about 50 mg/$m^2$; pressing a base sheet against the creping surface after the creping composition has been applied; and removing the base sheet from the creping surface.

In still other aspects the present disclosure provides a creped tissue web comprising a tissue web having a first side and a second side, the tissue web having been creped from a drum dryer to which a creping composition has been applied, the creping additive comprising at least two different cationic components and a film forming component.

DETAILED DESCRIPTION

Figure 1:
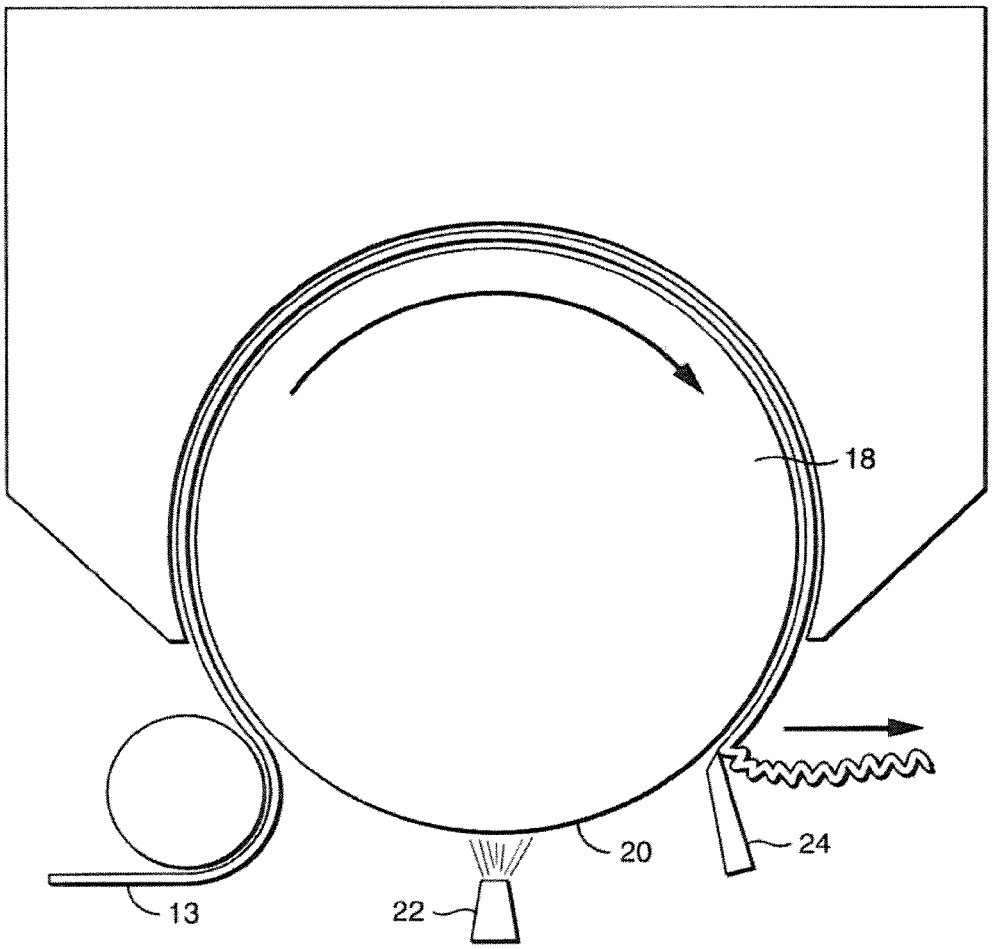
FIG. 1 illustrates one aspect of a Yankee dryer used to dry the fibrous web of the present disclosure.

The present disclosure relates generally to a tissue product comprising a creping composition disposed onto at least one surface thereof to increase the softness of the article, while retaining or improving manufacturing efficiency. Preferably the creping composition comprises a cationic component, which in a particularly preferred embodiment is a water soluble cationic polymer. The cationic component carries a cationic charge that is capable of forming ionic bonds with the negatively charged fibers of the tissue web, thus providing a retention mechanism by which the creping composition is retained on the sheet. The overall retention of the creping composition on the sheet reduces the concentration of the composition in the machine process water, improving machine operability and runability Improved retention also reduces the amount of creping composition entering mill waste water, which eliminates the need for additional treatment steps. Accordingly, the present disclosure provides a soft tissue product with high additive retention, such that only a small amount of the creping composition will dissolve when the product is placed in water, such as less than about 0.50 percent by weight of the tissue product. High retention of the creping composition is achieved even when the creping composition is applied to the Yankee dryer at relatively high addition levels, such as greater than about 50 mg/$m^2$.

Without being bound by any particular theory, it is believed that the cationic creping compositions of the present disclosure have a high affinity for the negatively charged cellulosic fiber web, yielding a web that retains a higher percentage of creping composition when wetted. The increased retention of creping chemistry is achieved without negatively affecting other web properties. In fact, web produced according to the present disclosure have crepe structures, Fuzz on Edge and softness values equal to or greater than web produced using methods of the prior art. Thus, once the creping compositions of the present disclosure are applied to the sheet surface, the composition is largely retained on the surface, with only a small amount of the composition entering the manufacturing process water.

Accordingly, the disclosure provides a creping composition that when applied to a tissue web yields a web that is soft and retains a large amount of the composition on its surface, preventing the introduction and buildup of the creping composition in the manufacturing process water. Thus, tissue products of the present invention preferably have a water soluble extractives, expressed as a weight percent, of less than about 1.0%, more preferably less than about 0.60%, still more preferably less than about 0.30%. In a particularly preferred embodiment creped tissue webs of the present disclosure have from about 0.35% to about 0.60% water soluble extractives by weight of the tissue web. Still more preferably the aforementioned water soluble extractives are achieved even when the composition is added to the creping surface, such as a Yankee dryer, at high levels, such as greater than about 50 mg of composition per square meter of the Yankee dryer surface, and still more preferably greater than about 100 $mg/m^2$, and even more preferably greater than about 150 $mg/m^2$.

While the amount of water soluble material extractable from the tissue products of the present invention are generally expressed as a percentage of the total weight of the tissue product, i.e., percent water soluble extractives, the amount may also be expressed as the mass of water soluble extractives relative to the area of a single ply of the tissue product. As such, in certain embodiments the water soluble extractives of any single ply of tissue product prepared according to the present disclosure is preferably less than about 150 $mg/m^2$ and still more preferably less than about 100 $mg/m^2$, such as from about 5 to about 50 $mg/m^2$.

To achieve the desired retention levels, tissue webs are creped using a creping composition comprising a cationic component. In certain embodiments the cationic component may be a cationic polymer. As used herein, the term "cationic polymer" refers to any polymer containing repeating units selected from cationic groups and groups which can be ionized into cationic groups, the polymer having a charge density greater than about 0 milliequivalents per gram of dry polymer. The term "cationic charge density" of a polymer, as that term is used herein, refers to the ratio of the number of positive charges on a polymer to the dry weight of the polymer. Charge density may be measured, for example, by polyelectrolyte titration using 0.001 N potassium polyvinyl sulfate as anionic polymer with a Mutek particle charge detector. Charge density is typically expressed as the number of milliequivalents of charge (quaternary nitrogen) per gram of dry polymer (mEq/g). In a particularly preferred embodiment the cationic polymer has a charge density of at least about 0.1 mEq/g, and more preferably from about 0.1 to about 2.0 mEq/g, such as from about 0.2 to about 1.0 mEq/g.

In certain embodiments the cationic component may comprise a cationic starch. As used herein the term "cationic starch" is defined as starch that has been chemically modified to impart a cationic constituent moiety. Preferably the starch is derived from corn or potatoes, but can be derived from other sources such as rice, wheat, or tapioca. Cationic starches can be divided into the following general classifications: (1) tertiary aminoalkyl ethers, (2) onium starch ethers including quaternary amines, phosphonium, and sulfonium derivatives, (3) primary and secondary aminoalkyl starches, and (4) miscellaneous (e.g., imino starches). Suitable cationic polymers include cationic starches having a charge density of at least about 0.1 mEq/g, such as, for example, Redibond™ 2038 which has a charge density of about 0.22 mEq/g.

Particularly preferred cationic starches for use in the creping additive of the present disclosure are the tertiary aminoalkyl ethers and quaternary ammonium alkyl ethers, which include commercial cationic starches produced by National Starch and Chemical Company, Bridgewater, N.J., under the trade names Redibond™ and Optipro™. Grades with cationic moieties only such as Redibond 5327™, Redibond 5330A™, and Optipro™ 650 are suitable, as are grades with additional anionic functionality such as Redibond 2038™.

In other embodiments the cationic component may comprise a vinylpyrrolidone/3-methyl-1-vinylimidazolium methyl sulfate, commercially available under the trade name Luvitec Quat™ 73 W, vinylpyrrolidone/3-methyl-1-vinylimidazolium chloride, commercially available under the under the trade name Luviquat™ Style or Luviquat™ Excellence. Other cationic components may include polyvinyl amine, commercially available under the trade name Luredur™. All of these materials are produced by BASF (Florham Park, N.J.).

The cationic component can be present in the creping composition in any operative amount and will vary based on the chemical component selected, as well as on the end properties that are desired. For example, in the exemplary case of Redibond 2038™, the cationic component can be present in the creping composition in an amount of about 10-90 wt %, such as 20-80 wt % or 30-70 wt % based on the total weight of the creping composition, to provide improved benefits.

Other suitable cationic components include cationic debonders and/or softeners. Cationic debonders and softeners are known in the papermaking art and are generally used as wet-end additives to enhance bulk and softness. Debonders are generally hydrophobic molecules that have a cationic charge. As wet end additives debonders function typically by disrupting inter-fiber bonding thereby increasing bulk and increasing perceived softness, but at the expense of a decrease in sheet strength. Softening agents are similar in chemistry to debonders, i.e., they are generally hydrophobic molecules that have a cationic charge. Typically they are applied to the surface of the paper web by spraying, binding to the fibers at the surface and providing them with a lubricous feel.

Examples of debonders and softening chemistries may include the simple quaternary ammonium salts having the general formula:

$$(R^{1'})_{4-b}—N^{+}—(R^{1''})_{b}X^{-}$$

wherein $R^{1'}$ is a $C_{1-6}$ alkyl group, $R^{1''}$ is a $C_{14-22}$ alkyl group, b is an integer from 1 to 3 and $X^{-}$ is any suitable counterion. Other similar compounds may include the monoester, diester, monoamide, and diamide derivatives of the simple quaternary ammonium salts. A number of variations on these quaternary ammonium compounds should be considered to fall within the scope of the present invention. Additional softening compositions include cationic oleyl imidazoline materials such as methyl-1-oleyl amidoethyl-2-oleyl imidazo linium methylsulfate commercially available as Mackernium CD-183 (McIntyre Ltd., University Park, Ill.) and Prosoft TQ-1003 (Ashland, Inc., Covington, Ky.).

In addition to a cationic component the creping additives of the present invention may further comprise a second component capable of forming a film when dried, hereinafter referred to as a "film forming component." Preferably the film forming component is water soluble, although the particular film forming component may vary depending upon the particular application and the desired result. In one aspect, for instance, the film forming component may be a hydroxylpropyl modified starch, such as Glucosol™ 800 (Chemstar, Minneapolis, Minn.). An additional film forming component is poly(ethylene oxide) such as those sold under the Polyox™ trade name, including at least Polyox™N3000 or Polyox™ N80 (Dow Chemical, Midland, Mich.). Other suitable film forming components include, cellulose ethers and esters and poly(acrylate esters). Examples of other suitable commercially available film forming components include the methyl cellulose (MC) sold under the trade name of Benecel™, hydroxypropyl cellulose (HPC) sold under the trade name Klucel™ and the hydroxyethyl cellulose under the trade name of Natrosol™ (all available from Ashland, Inc. Covington, Ky.). Other suitable film forming components include polysaccharides of sufficient chain length to form films such as, but not limited to, pullulan and pectin. The film-forming polymer can also contain additional monoethylenically unsaturated monomers that do not bear a pendant acid group, but are copolymerizable with monomers bearing acid groups. Such compounds include, for example the monoacrylic esters and monomethacrylic esters of polyethylene glycol or polypropylene glycol, the molar masses (Mn) of the polyalkylene glycols being up to about 2,000, for example.

The film forming component can be present in the creping composition in any operative amount and will vary based on the chemical component selected, as well as on the end properties that are desired. For example, in the exemplary case of Glucosol™ 800, the film forming component can be present in the creping composition in an amount from about 10-90 wt %, such as 20-80 wt % or 30-70 wt % based on the total weight of the creping composition, to provide improved benefits. In the exemplary case of Klucel™, the film forming component can be present in the creping composition in an amount of about 1-70 wt %, or at least about 1 wt %, such as at least about 5 wt %, or least about 10 wt %, or up to about 30 wt %, such as up to about 50 wt % or up to about 75 wt % or more, based on the total weight of the creping composition, to provide improved benefits.

In some aspects, the film forming component is dissolved into a 1 wt % to about 10 wt % aqueous solution, and diluted further as required to provide the desired dosage in mg/m$^2$ of dryer surface. The dosage is estimated based on the volume of film forming solution multiplied by the film forming concentration and divided by the square meters of tissue treated per unit time.

In other embodiments the creping composition may also comprise at least one adhesive component capable of adhering the web to the surface of a dryer. Preferably the adhesive component is non-cross-linking and water soluble. The adhesive component contained within the creping composition may vary depending upon the particular application and the desired result. In a preferred embodiment, the adhesive component is the polymerization product of a cationic acrylate or methacrylate and one or more alkyl acrylates or methacrylates. A preferred adhesive component is a cationic polyacrylate that is the polymerization product of 96 mol % methyl acrylate and 4 mol % [2-(acryloyloxy)ethyl]trimethyl ammonium chloride, also referred to herein as L7170, which is disclosed in U.S. Pat. No. 7,157,389, which is incorporated herein in a manner consistent herewith.

The adhesive components of the present disclosure may have an average molecular weight that varies depending on the ultimate use of the polymer. The adhesive components of the present disclosure have a weight average molecular weight ranging from about 5,000 to about 500,000 grams per mol. More specifically, the adhesive components of the present disclosure have a weight average molecular weight ranging from about 8,000 to about 500,000 grams per mol.

The adhesive component can be present in the creping composition in any operative amount and will vary based on the chemical component selected, as well as on the end properties that are desired. For example, in the exemplary case of L7170, the adhesive component can be present in the creping composition in an amount of about 10-90 wt %, such as 20-80 wt % or 30-70 wt % based on the total weight of the creping composition, to provide improved benefits.

In some aspects, the adhesive component is dissolved into a 1 wt % to about 10 wt % aqueous solution, and diluted further as required to provide the desired dosage in mg/m$^2$ of tissue surface. The dosage is estimated based on the volume of adhesive solution multiplied by the adhesive concentration and divided by the square meters of tissue treated per unit time. For example, in the exemplary case of L7170 the adhesive component can be present in the creping composition in an amount of about 1-70 wt %, or at least about 1 wt %, such as at least about 5 wt %, or least about 10 wt %, or up to about 30 wt %, such as up to about 50 wt % or up to about 75 wt % or more, based on the total weight of the creping composition, to provide improved benefits. Any of these chemistries, once diluted in water, are disposed onto a Yankee dryer surface with a spray boom to ultimately transfer to the web surface.

In one embodiment, the creping composition may be applied topically to the web during a creping process. For instance, the creping composition may be sprayed onto a heated dryer drum in order to adhere the web to the dryer drum. The web can then be creped from the dryer drum. When the creping composition is applied to the web and then adhered to the dryer drum, the composition may be uniformly applied over the surface area of the web or may be applied according to a particular pattern. An exemplary creping process is disclosed in U.S. Pat. No. 7,883,604, which is incorporated herein by reference in a manner that is consistent herewith. One preferred creping method is illustrated in FIG. 1. In the embodiment illustrated in FIG. 1, the creping composition is applied directly onto the dryer surface 20 (e.g., a Yankee dryer) using a spray boom 22, however other means of application such as printing, foaming and wiping are contemplated. The fibrous web 13 is adhered to the surface of the Yankee dryer when it is pressed into contact with the composition. The fibrous web and the composition are subsequently scraped off of the dryer surface by a creping blade 24.

The creping composition provides a tissue having a very fine crepe structure, where the crepe folds are small in both frequency and amplitude. This results in a smoother and softer tissue sheet. In addition to having a fine crepe structure, individual fibers protrude from the surface of the tissue while still being attached. These individual fibers protruding from the surface are called free fiber ends and provide enhanced softness, due to both the fuzziness of the tissue surface, as well as by the softening of the fibers from the coating of the creping composition. Evidence for free fiber ends are provided by visual images generated with SEM and the "Fuzz on Edge" test, as described in the Test Method section. Accordingly, in certain embodiments the present disclosure provides a tissue web having a fine crepe structure, measured as percent COV at 0.28-0.55 mm of less than about 25%, such as from about 15 to about 25% and more preferably from about 18 to about 25%. In other embodiments the tissue webs have a Fuzz on Edge of greater than about 0.90 mm/mm, such as from about 0.90 to about 1.2 mm/mm and more preferably from about 0.95 to about 1.1 mm/mm.

In addition to having improved surface properties, tissue prepared according to the present disclosure also has relatively low water soluble extractives. It is believed that the cationic components of the creping composition improve retention of the creping composition on the positively charged fiber surface, preventing the introduction and buildup of the creping composition in the manufacturing process water. Thus, tissue products of the present invention preferably have a water soluble extractives, expressed as a weight percent, of less than about 1.0%, more preferably less than about 0.60%, still more preferably less than about 0.30%. In a particularly preferred embodiment creped tissue webs of the present disclosure have from about 0.35% to about 0.60% water soluble extractives by weight of the tissue web.

In other embodiments tissue sheets made according to the present disclosure may possess a desirable water absorption rate. The water absorption rate of cellulose based tissue products affects functional performance. In one example, facial tissue must be sufficiently strong in use and also wet out very fast in order to absorb liquids, such as nasal discharge. Generally tissues produced according to the methods disclosed in U.S. Pat. No. 7,883,604, have slow wet out times, likely due to the water insoluble creping chemistry that is transferred to the surface of the tissue. Compared to conventional creping chemistry and other competitive commercially available tissues, tissues produced according to the methods disclosed in U.S. Pat. No. 7,883,604 have a Wet Out time that is at least 2 times slower (measured as described below in the test methods section), such as greater than about 10 seconds and in some instances greater than about 30 seconds. By contrast the Wet Out times of the tissue produced according to certain embodiments of the present disclosure is generally less than about 6 seconds. Accordingly, in certain embodiments the Wet Out Time can be about 6 seconds or less, more specifically about 5 seconds or less, more specifically about 2.5 seconds or less.

Water absorption rate may alternatively be measured using the Hercules Size Test (HST). In certain embodiments it may be desirable from a user's perspective to have a tissue product that is soft, sufficiently strong in use and also wet out very fast in order to absorb liquids, such as nasal discharge. Accordingly, the disclosure provides a soft tissue product having good strength that also has an HST value less than about 1.5 seconds, such as less than about 1 second, for example from about 0.5 to about 1 second.

Compared to commercially available tissue, tissue prepared according to the present disclosure generally has a finer crepe structure, increased Fuzz on Edge and faster Wet Out time, all while having relatively low water soluble extractives, as summarized in the table below.

TABLE 1

| Sample | Fine Crepe Structure (% COV @ 0.28-0.55 mm) | Fuzz on Edge (PR/EL) | Wet Out (sec.) | Water Soluble Extractables (% by weight) |
|---|---|---|---|---|
| KLEENEX ® Facial Tissue | 16.97 | 0.58 | 69.2 | 0.19 |
| PUFFS ® Facial Tissue | 30.3 | 0.81 | 5.7 | 0.28 |
| PUFFS PLUS ® Facial Tissue | 27.7 | 0.78 | 106.6 | 0.24 |
| HOMELIFE Whisper Soft Facial Tissue | 30.8 | 0.78 | 2.3 | 0.24 |

TABLE 1-continued

| Sample | Fine Crepe Structure (% COV @ 0.28-0.55 mm) | Fuzz on Edge (PR/EL) | Wet Out (sec.) | Water Soluble Extractables (% by weight) |
|---|---|---|---|---|
| SCOTTIES ® Hypoallergenic Facial Tissue | 24.7 | 0.95 | 2.4 | 0.28 |
| Inventive Sample | 18.47 | 1.00 | 2.4 | 0.29 |
| Inventive Sample | 19.51 | 0.99 | 2.2 | 0.25 |

In general, any suitable fibrous web may be treated in accordance with the present disclosure. For example, in one aspect, the base sheet can be a tissue product, such as a bath tissue, a facial tissue, a paper towel, a napkin, dry and moist wipes, and the like. Fibrous products can be made from any suitable types of fiber. Fibrous products made according to the present disclosure may include single-ply fibrous products or multiple-ply fibrous products. For instance, in some aspects, the product may include two plies, three plies, or more.

Fibers suitable for making fibrous webs comprise any natural or synthetic fibers including both nonwoody fibers and woody or pulp fibers. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. Nos. 4,793,898, 4,594,130, 3,585,104. Useful fibers can also be produced by anthraquinone pulping, exemplified by U.S. Pat. No. 5,595,628.

The fibrous webs of the present disclosure can also include synthetic fibers. For instance, the fibrous webs can include up to about 10%, such as up to about 30% or up to about 50% or up to about 70% or more by dry weight, to provide improved benefits. Suitable synthetic fibers include rayon, polyolefin fibers, polyester fibers, bicomponent sheath-core fibers, multi-component binder fibers, and the like. Synthetic cellulose fiber types include rayon in all its varieties and other fibers derived from viscose or chemically-modified cellulose.

Chemically treated natural cellulosic fibers can be used, for example, mercerized pulps, chemically stiffened or crosslinked fibers, or sulfonated fibers. For good mechanical properties in using web forming fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable web forming fibers can also include recycled fibers, virgin fibers, or mixes thereof.

In general, any process capable of forming a web can also be utilized in the present disclosure. For example, a web forming process of the present disclosure can utilize creping, wet creping, double creping, recreping, double recreping, embossing, wet pressing, air pressing, through-air drying, hydroentangling, creped through-air drying, co-forming, air laying, as well as other processes known in the art. For hydroentangled material, the percentage of pulp is about 70-85%.

Also suitable for articles of the present disclosure are fibrous sheets that are pattern densified or imprinted, such as the fibrous sheets disclosed in any of the following U.S. Pat.

Nos. 4,514,345, 4,528,239, 5,098,522, 5,260,171, and 5,624,790, the disclosures of which are incorporated herein by reference to the extent they are non-contradictory herewith. Such imprinted fibrous sheets may have a network of densified regions that have been imprinted against a drum dryer by an imprinting fabric, and regions that are relatively less densified (e.g., "domes" in the fibrous sheet) corresponding to deflection conduits in the imprinting fabric, wherein the fibrous sheet superposed over the deflection conduits was deflected by an air pressure differential across the deflection conduit to form a lower-density pillow-like region or dome in the fibrous sheet.

The fibrous web can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone, quaternary salt and unsaturated fatty alkyl amine salts. Other suitable debonding agents are disclosed in U.S. Pat. No. 5,529,665, which is incorporated herein by reference in a manner consistent herewith.

Optional chemical additives may also be added to the aqueous web forming furnish or to the formed embryonic web to impart additional benefits to the product and process and are not antagonistic to the intended benefits of the invention. The following chemicals are included as examples and are not intended to limit the scope of the invention.

The types of chemicals that may be added to the paper web include absorbency aids usually in the form of cationic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin-E, silicone, lotions in general, and the like, may also be incorporated into the finished products. Such chemicals may be added at any point in the web forming process.

In general, the products of the present disclosure can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, humectants, emollients, and the like.

Fibrous webs that may be treated in accordance with the present disclosure may include a single homogenous layer of fibers or may include a stratified or layered construction. For instance, the fibrous web ply may include two or three layers of fibers. Each layer may have a different fiber composition. For example, referring to FIG. 3, one aspect of a device for forming a multi-layered stratified pulp furnish is illustrated. As shown, a three-layered headbox 10 generally includes an upper head box wall 12 and a lower head box wall 14. Headbox 10 further includes a first divider 16 and a second divider 19, which separate three fiber stock layers.

Each of the fiber layers comprises a dilute aqueous suspension of papermaking fibers. The particular fibers contained in each layer generally depend upon the product being formed and the desired results. For instance, the fiber composition of each layer may vary depending upon whether a bath tissue product, facial tissue product or paper towel is being produced. In one aspect, for instance, middle layer 21 contains southern softwood kraft fibers either alone or in combination with other fibers such as high yield fibers. Outer layers 23 and 25, on the other hand, contain softwood fibers, such as northern softwood kraft.

In an alternative aspect, the middle layer may contain softwood fibers for strength, while the outer layers may comprise hardwood fibers, such as eucalyptus fibers, for a perceived softness.

Figure 3:
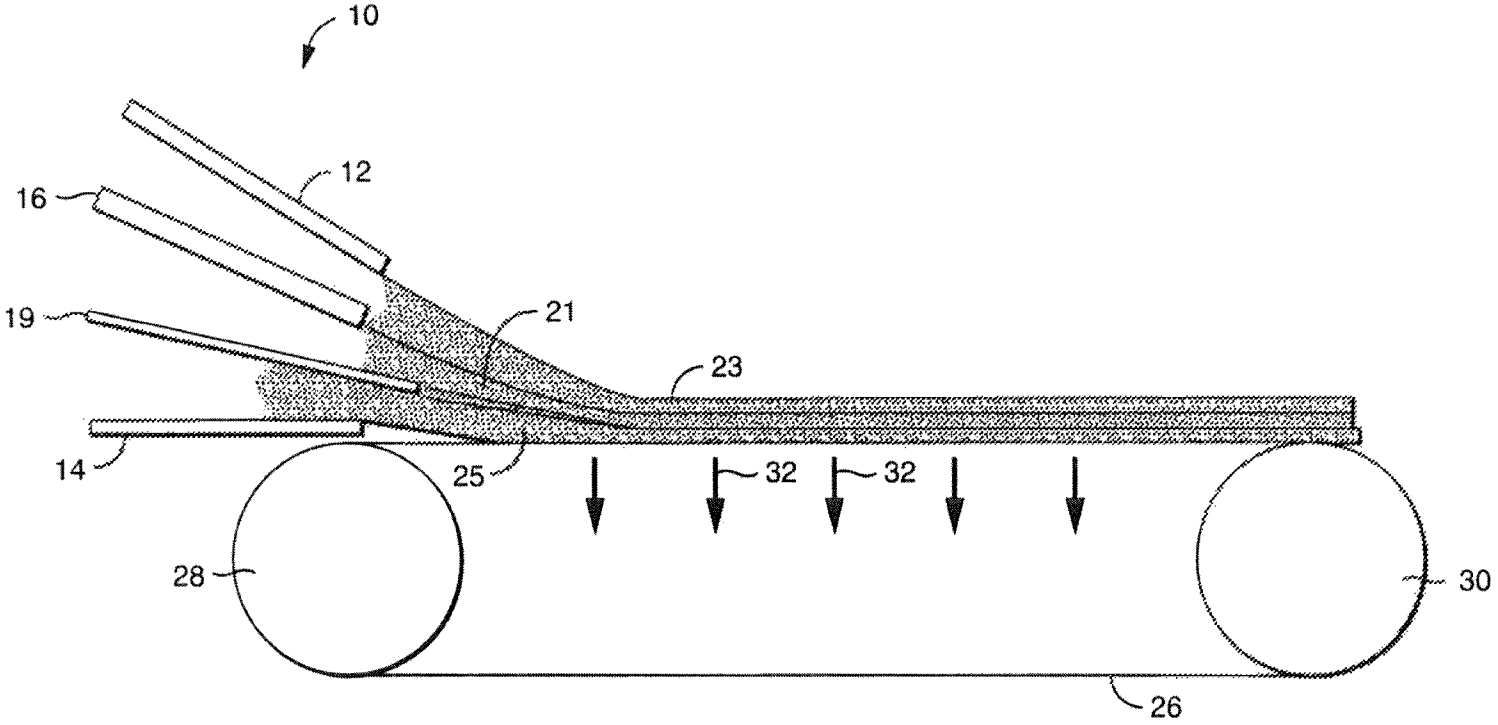
FIG. 3 illustrates a portion of a fibrous web forming machine, illustrating one aspect of the formation of a stratified fibrous web having multiple layers.

In general, any process capable of forming a base sheet may be utilized in the present disclosure. For example, as illustrated in FIG. 3, an endless traveling forming fabric 26, suitably supported and driven by rolls 28 and 30, receives the layered papermaking stock issuing from headbox 10. Once retained on fabric 26, the layered fiber suspension passes water through the fabric as shown by the arrows 32. Water removal is achieved by combinations of gravity, centrifugal force and vacuum suction depending on the forming configuration. Forming multi-layered paper webs is also described and disclosed in U.S. Pat. No. 5,129,988, which is incorporated herein by reference in a manner that is consistent herewith.

The basis weight of fibrous webs made in accordance with the present disclosure can vary depending upon the final product. For example, the process may be used to produce bath tissues, facial tissues, paper towels, and the like. In general, the basis weight of such fibrous products may vary from about 5 gsm to about 110 gsm, such as from about 10 gsm to about 90 gsm. For bath tissue and facial tissues, for instance, the basis weight may range from about 10 gsm to about 40 gsm. For paper towels, on the other hand, the basis weight may range from about 25 gsm to about 80 gsm or more.

Webs made according to the above processes can have relatively good bulk characteristics. For instance, the fibrous web bulk may vary from about 1 to about 20 cc/g, such as from about 3 to about 15 cc/g or from about 5 to about 12 cc/g. Surprisingly, it has been discovered that treatment of tissue products with the creping composition of the present disclosure results in tissue products having greater bulk relative to creped tissue products prepared according to the prior art. For example, tissue products of the present invention have bulks that are from about 8 cc/g to about 10 cc/g. The bulks achieved are from about 10% to about 40% greater than creped tissue products prepared according to the prior conventional wet pressed creping art. The increased bulk achieved by applying the creping compositions of the present disclosure may reduce the amount of calendering required during converting and enable improved tissue bulk such that the bulk of the tissue product is from about 8 cc/g to about 10 cc/g.

In multiple-ply products, the basis weight of each fibrous web present in the product can also vary. In general, the total basis weight of a multiple ply product will generally be the same as indicated above. In particularly preferred embodiments the tissue product is a multiply facial tissue wherein each ply has a basis weight from about 10 gsm to about 20 gsm and more particularly from about 12 gsm to about 15 gsm.

Figure 2:
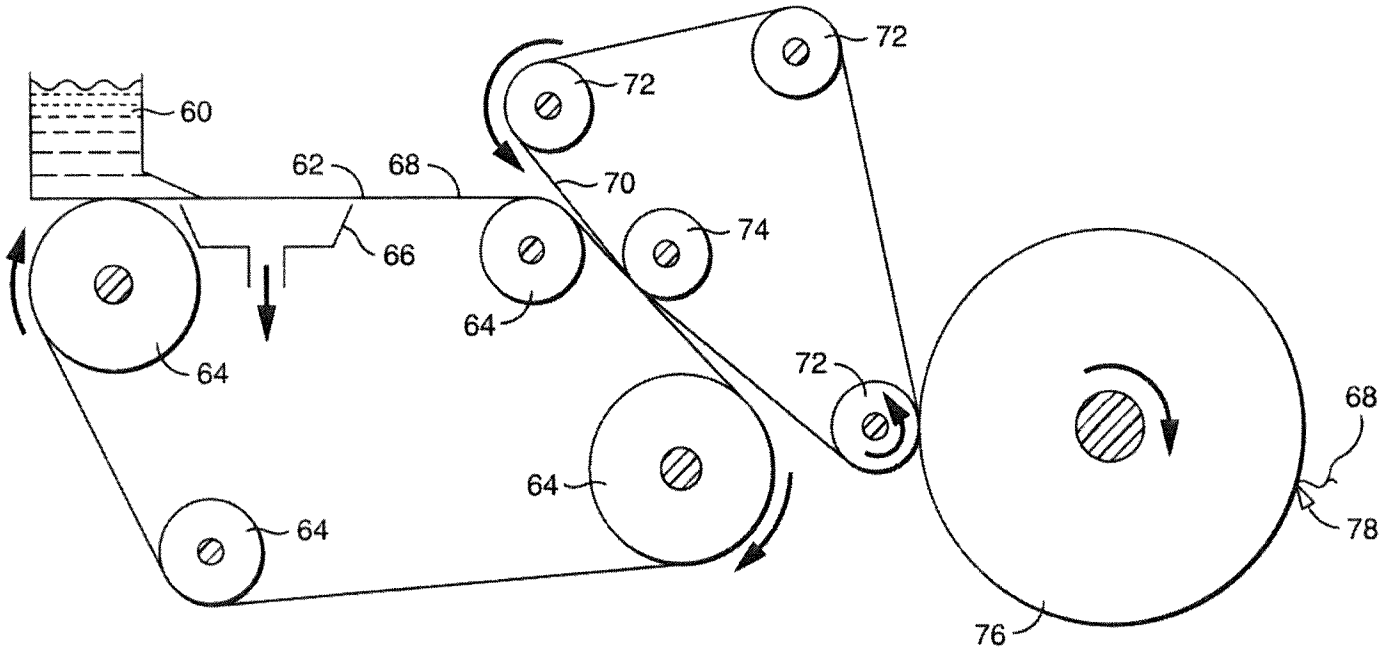
FIG. 2 illustrates one embodiment for forming wet creped fibrous webs for use in the present disclosure.

Now with reference to FIG. 2, a headbox 60 emits an aqueous suspension of fibers onto a forming fabric 62 which is supported and driven by a plurality of guide rolls 64. A vacuum box 66 is disposed beneath forming fabric 62 and is adapted to remove water from the fiber furnish to assist in forming a web. From forming fabric 62, a formed web 68 is transferred to a second fabric 70, which may be either a wire or a felt. Fabric 70 is supported for movement around a continuous path by a plurality of guide rolls 72. Also included is a pick up roll 74 designed to facilitate transfer of web 68 from fabric 62 to fabric 70.

Preferably the formed web is dried by transfer to the surface of a rotatable heated dryer drum, such as a Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as web is carried through a portion of the rotational path of the dryer surface, heat is imparted to the web causing most of the moisture contained within the web to be evaporated. The web is then removed from dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25° C. to about 200° C., such as from about 100° C. to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade. Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process.

Specifically, once topically applied to a fibrous web, the creping composition has been found well-suited to adhering the fibrous web to a creping surface, such as in a print-creping operation.

For example, once a fibrous web is formed and dried the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

In one embodiment the creping composition may be added to one side of the web by creping, using either an in-line or off-line process. A tissue web made according to the process illustrated in FIG. 2 or FIG. 3 or according to a similar process is passed through a first creping composition application station that includes a nip formed by a smooth rubber press roll and a patterned rotogravure roll. The rotogravure roll is in communication with a reservoir containing a first creping composition. The rotogravure roll applies the creping composition to one side of web in a preselected pattern. The web is then contacted with a heated roll, which can be heated to a temperature, for instance, up to about 200° C., and more preferably from about 100° C. to about 150° C. In general, the web can be heated to a temperature sufficient to dry the web and evaporate any water. It should be understood, that besides the heated roll, any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll, the web can be advanced by pull rolls to a second creping composition application station, which includes a transfer roll in contact with a rotogravure roll, which is in communication with a reservoir containing a second creping composition. The second creping composition may be applied to the opposite side of web in a preselected pattern. The first and second creping compositions may contain the same ingredients or may contain different ingredients. Alternatively, the creping compositions may contain the same ingredients in different amounts as desired. Once the second creping composition is applied the web is adhered to a creping roll by a press roll and carried on the surface of the creping drum for a distance and then removed therefrom by the action of a creping blade. The creping blade performs a controlled pattern creping operation on the second side of the tissue web. Although the creping composition is being applied to each side of the tissue web, only one side of the web undergoes a creping process. It should be understood, however, that in other embodiments both sides of the web may be creped.

Once creped the tissue web may be pulled through a drying station. The drying station can include any form of a heating unit, such as an oven energized by infra-red heat, microwave energy, hot air or the like. A drying station may be necessary in some applications to dry the web and/or cure the creping composition. Depending upon the creping composition selected, however, in other applications a drying station may not be needed.

The creping compositions of the present disclosure are typically transferred to the web at high levels, such that at least about 30% of the creping composition applied to the Yankee is transferred to the web, more preferably at least about 45% is transferred and still more preferably at least about 60% is transferred. Generally from about 45% to about 65% of the creping composition applied to the Yankee dryer is transferred to the web. Thus, the amount of creping additive transferred to the sheet is a function of the amount of creping additive applied to the Yankee dryer. For instance, at 100 $mg/m^2$ spray coverage on the Yankee dryer, it is estimated that about 0.5% creping composition solids is incorporated into the tissue web. At 200 $mg/m^2$ spray coverage on the Yankee dryer, it is estimated that about 1.0% creping composition solids is incorporated into the tissue web.

The total amount of creping composition applied to each side of the web can be in the range of from about 0.1% to about 10% by weight, based upon the total weight of the web, such as from about 0.3% to about 5% by weight, such as from about 0.5% to about 3% by weight. To achieve the desired additive application levels the add on rate of creping composition to the dryer, measured as mass (i.e., mg) per unit area of dryer surface (i.e., $m^2$), may range from about 50 $mg/m^2$ to about 300 $mg/m^2$, and still more preferably from about 150 $mg/m^2$ to about 250 $mg/m^2$.

Further, the creping composition is applied to the paper web so as to cover from about 15% to about 100% of the surface area of the web. More particularly, in most applications, the creping composition will cover from about 20% to about 60% of the surface area of each side of the web.

In one aspect, fibrous webs made according to the present disclosure can be incorporated into multiple-ply products. For instance, in one aspect, a fibrous web made according to the present disclosure can be attached to one or more other fibrous webs for forming a wiping product having desired characteristics. The other webs laminated to the fibrous web of the present disclosure can be, for instance, a wet-creped web, a calendered web, an embossed web, a through-air dried web, a creped through-air dried web, an uncreped through-air dried web, an airlaid web, and the like.

In one aspect, when incorporating a fibrous web made according to the present disclosure into a multiple-ply product, it may be desirable to only apply the creping composition to one side of the fibrous web and to thereafter crepe the treated side of the web. The creped side of the web is then used to form an exterior surface of a multiple-ply product. The untreated and uncreped side of the web, on the other hand, is attached by any suitable means to one or more plies.

Test Methods

Water Soluble Extractives

The term "water soluble extractives" refers to the amount of material from a tissue sheet that dissolves into water and can be expressed as either a weight percent of the tissue sheet or as a weight per unit area of the tissue sheet ($mg/m^2$ or $g/m^2$). Multi-ply tissues can be separated into the individual plies and the water soluble extractives determined for each ply. If the plies are of the same composition, the water soluble extractives measured using the multi-ply tissue sheet can then be divided by the number of equivalent plies.

The area of a 1-2 gram sample of the tissue sheet to be tested is measured; it is then weighed on an analytical balance to the nearest 0.0001 g, and finally placed in a 100 ml specimen cup. Fifty milliliters of room temperature deionized water is added to the specimen cup (VWR Specimen Container, Catalog No. 25384-148). The specimen cup is capped and shaken on a flat-bed shaker at 150 rpm for one hour. After extraction the sample is vacuum filtered using a porcelain Coors Buchner funnel (87 mL capacity) containing a Whatman 934-AH glass microfiber filter (Whatman Catalog No. 1827-042, Whatman Inc., GE Healthcare, www.whatman.com), and a 125 mL filter flask. All of the contents of the cup are transferred onto the filter with a forceps. The specimen cup is rinsed twice with about 10 mL of deionized water and poured over the tissue sheet in the funnel. The tissue sheet in the funnel is then washed with 5 mL of deionized water, turned over with a forceps and washed with an additional 5 mL of deionized water. The tissue sheet in the funnel is then compressed using the plunger from a disposable syringe to release absorbed water. The extract (filtrate) is transferred to a tared 100 mL beaker. The filter flask is rinsed twice with 10 mL deionized water and combined with the extract in the beaker. The total volume in the beaker is nearly 100 mL. The beaker is dried in an oven at 105° C. for 18 hours, cooled, and weighed.

The percent water extractives (% WSE) is calculated from the tissue weight and the tare and final weights of the beaker.

$$\%\ \text{Water Soluble Extractives} = \frac{(\text{final beaker weight} - \text{tare beaker weight})}{\text{tissue weight}} \times 100$$

The water extractives in $mg/m^2$ is calculated using the percent water soluble extractives and the basis weight of the tested tissue sheet.

$$\text{Water Soluble Extractives } (mg/m^2) = (\%\ WSE) \times \left[\frac{(\text{weight of tissue sheet (g)})}{(\text{area of tissue sheet } (m^2))}\right] \times 1000$$

Three tests are completed per sample. The average percent water soluble extractives and average water soluble extractives ($mg/m^2$) are reported for each sample.

Absorbent Rate Test

The "Absorbency Rate (Wet-Out Time) Test" is used to determine the absorbency wet out time ("Wet Out Time"). To carry out the test, the test product is first equilibrated to ambient conditions for at least four hours at 23±3.0° C. and 50±5% relative humidity. Twenty (20) sheets are stacked and cut to a 60×60 mm (±3 mm) square using a device capable of cutting to the specified dimensions such as a Hudson Machinery. The square is then fixed in each corner by staples delivered by a standard, commercially available manual office stapler. The staples are placed diagonally across each corner far enough into the sheet so that the staples are completely contacting the tissue sheets, staples should not wrap the corner of the sample. The sample is then held horizontally and approximately 25 mm (1 inch) over a container containing distilled or de-ionized water at 23.0±3.0° C. The container should be of sufficient size and depth to ensure that the saturated specimen does not contact the sides, bottom of the container, and the top surface of the water at the same time. The container should contain a minimum depth of 51 mm of water to ensure complete saturation of the test specimen and this depth should be maintained throughout the testing. The specimen is then dropped flat onto the water surface and a timing device is started when the specimen contacts the water surface. As soon as the specimen is completely saturated, stop the timing device and record the absorbency wet out time in seconds.

Fuzz on Edge

The Fuzz on Edge methodology measures the amount of fibers that protrude from the surface of a fibrous material. The measurement is performed using image analysis to detect and then measure the total perimeter of protruding surface fibers observed when the material in question is wrapped over an "edge" to allow the fibers to be viewed from the side using transmitted light. An image analysis algorithm was developed to detect and measure the perimeter length (mm) of the fibers per edge length (mm) of material, where the perimeter length is defined as the total length of the boundaries of all of the protruding fibers (i.e. Perimeter/Edge Length or PR/EL for short). For example, an edge along the majority of the length of a fibrous material (e.g. facial tissue) can be measured by acquiring and analyzing multiple, adjacent fields-of-view to arrive at a single PR/EL value. Typically, several such material specimens are analyzed for a sample to arrive at a mean PR/EL value.

The Fuzz on Edge was determined using the method described in US Publication No. 2010/0155004 with the following modifications. A Leica DFX-300 camera (Leica Microsystems Ltd, Heerbrugg, Switzerland) is mounted on a Polaroid MP-4 Land Camera (Polaroid Resource Center, Cambridge, Mass.) standard support. The support is attached to a Kreonite macro-viewer (Kreonite, Inc., Wichita, Kans.). An auto-stage, DCI Model HM-1212, is placed on the upper surface of the Kreonite macro-viewer and the sample mounting apparatus was placed atop the auto-stage (commercially available from Design Components Incorporated, Franklin, Mass.). The auto-stage is used to move the sample in order to obtain 15 separate and distinct, non-overlapping images from the specimen. The sample mounting apparatus is placed on the auto macro-stage (DCI 12×12 inch) of an image analysis system controlled by Leica Microsystems QWIN Pro software, under the optical axis of a 60-mm AF Micro Nikon lens (Nikon Corp., Japan) fitted with a 20-mm extension tube. The lens focus is adjusted to provide the maximum magnification and the camera position on the Polaroid MP-4 support is adjusted to provide optimum focus of the tissue edge. The sample is illuminated from beneath the auto-stage using a Chroma Pro 45 (Circle 2, Inc., Tempe, Ariz.). The Chroma Pro settings are such that the light is 'white' and not filtered in any way to bias the light's spectral output. The Chroma Pro may be connected to a POWERSTAT Variable Auto-transformer, type 3PN117C, which may be purchased from Superior Electric, Co. having an office in Bristol, Conn. The auto-transformer is used to adjust the Chroma Pro's illumination level.

Crepe Structure Analysis

To determine the structure of the tissue sheet after creping the crepe structure was characterized using tissue images and the STFI mottling program as described in US Publication No. 2010/0155004 with the following modifications. The STFI mottling program has been written to run with Matlab computer software for computation and programming. A grayscale image is uploaded to the program where an image of the tissue in question had been generated under controlled, low-angle lighting conditions with a video camera, frame grabber and an image acquisition algorithm.

A Leica DFX-300 camera (Leica Microsystems Ltd, Heerbrugg, Switzerland) 420 is mounted on a Polaroid MP-4 Land Camera (Polaroid Resource Center, Cambridge, Mass.) standard support 422. The support is attached to a Kreonite macro-viewer available from Kreonite, Inc., having an office in Wichita, Kans. An auto-stage, DCI Model HM-1212, is placed on the upper surface of the Kreonite macro-viewer and the sample mounting apparatus was placed atop the auto-stage. The auto-stage is a motorized apparatus known to those skilled in the analytical arts which was purchased from Design Components Incorporated (DCI), having an office in Franklin, Mass. The auto stage is used to move the sample in order to obtain 15 separate and distinct, non-overlapping images from the specimen. The sample mounting apparatus 424 is placed on the auto macro-stage (DCI 12×12 inch) of an image analysis system controlled by Leica Microsystems QWIN Pro software, under the optical axis of a 60-mm AF Micro Nikon lens (Nikon Corp., Japan) fitted with a 20-mm extension tube. The lens focus is adjusted to provide the maximum magnification and the camera position on the Polaroid MP-4 support is adjusted to provide optimum focus of the tissue edge. The sample is illuminated from beneath the auto-stage using a Chroma Pro 45 (Circle 2, Inc., Tempe, Ariz.). The Chroma Pro settings are such that the light is 'white' and not filtered in any way to bias the light's spectral output. The Chroma Pro may be connected to a POWERSTAT Variable Auto-transformer, type 3PN117C, which may be purchased from Superior Electric, Co. having an office in Bristol, Conn. The auto-transformer is used to adjust the Chroma Pro's illumination level. The resulting image has a pixel resolution of 1024×1024 and represents a 12.5 mm×12.5 mm field of view.

The image analysis system used to perform the PR/EL measurements may be a QWIN Pro (Leica Microsystems, Heerbrugg, Switzerland). The system is controlled and run by Version 3.2.1 of the QWIN Pro software. The image analysis algorithm 'FOE3a' is used to acquire and process grayscale monochrome images using Quantimet User Interactive Programming System (QUIPS) language. Alternatively, the FOE3a program could be used with newer QWIN Pro platforms which run newer versions of the software (e.g. QWIN Pro Version 3.5.1). The image analysis program was previously described in US Publication No. 2010/0155004.

The STFI mottling software analyzes the grayscale variation of the image in both the MD and CD directions by using FFT (Fast Fourier Transform). The FFT is used to develop grayscale images at different wavelength ranges based on the frequency information present within the FFT. The grayscale coefficient-of-variation (% COV) is then calculated from each of the images (e.g. inverse FFT's) corresponding to the wavelengths which were pre-determined by the STFI software. Since these images are generated with low-angle lighting, the tissue surface structure is shown as areas of light and dark, due to shadowing, and consequently the grayscale variation can be related to the tissue surface structure. For each code, 3 tissues are analyzed with 6 images from each tissue, resulting in a total of 18 images analyzed per code.

HST

The "Hercules Size Test" (HST) is a test that generally measures how long it takes for a liquid to travel through a tissue sheet. Hercules size testing was done in general accordance with TAPPI method T 530 PM-89, Size Test for Paper with Ink Resistance. Hercules Size Test data was collected on a Model HST tester using white and green calibration tiles and the black disk provided by the manufacturer. A 2% Napthol Green N dye diluted with distilled water to 1% was used as the dye. All materials are available from Ashland, Inc., Covington, Ky.

Six (6) tissue sheets (18 plies for a 3-ply tissue product, 12 plies for a two-ply product, 6 plies for a single ply product, etc.) form the specimen for testing. All specimens were conditioned for at least 4 hours at 23±1° C. and 50±2% relative humidity prior to testing. Specimens are cut to an approximate dimension of 2.5×2.5 inches. The specimen (12 plies for a 2-ply tissue product) is placed in the sample holder with the outer surface of the plies facing outward. The specimen is then clamped into the specimen holder. The specimen holder is then positioned in the retaining ring on top of the optical housing. Using the black disk, the instrument zero is calibrated. The black disk is removed and 10±0.5 mm of dye solution is dispensed into the retaining ring and the timer started while placing the black disk back over the specimen. The test time in seconds (sec.) is recorded from the instrument.

EXAMPLES

Example 1

Inventive sample codes were made using a wet pressed process utilizing a Crescent Former. Initially, northern softwood kraft (NSWK) pulp was dispersed in a pulper for 30 minutes at 4% consistency at about 100° F. The NSWK pulp was then transferred to a dump chest and subsequently diluted to approximately 3% consistency. The NSWK pulp was refined at 5.2 hp-days/metric ton. The amount of softwood fibers were evenly split and added to the middle and felt side layers in the 3-layer tissue structure. The virgin NSWK fiber content contributed approximately 30-40% of the final sheet weight. 1.8-2 kilograms Kymene® 920A and 0.9-1.1 kilograms Baystrength 3000 (Kemira, Kennesaw, Ga.) per metric ton of wood fiber were added to the NSWK pulp prior to the headbox.

Aracruz ECF, a eucalyptus hardwood Kraft (EHWK) pulp (Aracruz, Rio de Janeiro, RJ, Brazil) was dispersed in a pulper for 30 minutes at about 4% consistency at about 100° F. The EHWK pulp was then transferred to a dump chest and subsequently diluted to about 3% consistency. The EHWK pulp fibers were added to all three layers of the 3-layered tissue structure. Only EHWK pulp fibers were added to the dryer layer of the 3-layer structure; the dryer layer represented 40% of the final sheet weight. The remainder of the EHWK pulp fibers were evenly split between the middle and felt layers. The EHWK layers contributed approximately 60-70% of the final sheet weight. 1.8-2 kilograms Kymene® 920A per metric ton of wood fiber was added to the EHWK pulp prior to the headbox.

The pulp fibers from the machine chests were pumped to the headbox at a consistency of about 0.1%. Pulp fibers from each machine chest were sent through separate manifolds in the headbox to create a 3-layered tissue structure. The fibers were deposited onto a felt using a Crescent Former.

The wet sheet, about 10-20% consistency, was adhered to a Yankee dryer, traveling at about 4600 fpm (1400 mpm) through a nip via a pressure roll. The consistency of the wet sheet after the pressure roll nip (post-pressure roll consistency or PPRC) was approximately 40%. The wet sheet is adhered to the Yankee dryer due to the additive composition that is applied to the dryer surface. A spray boom situated underneath the Yankee dryer sprayed the creping/additive composition, described in the present disclosure, onto the dryer surface at addition levels ranging from 150 to 200 mg/m$^2$.

The creping compositions of Glucosol™ 800, Redibond™ 2038A, and Prosoft™ TQ1003 that were applied to the Yankee dryer were prepared by dilution of the polymer solutions into water followed by stiffing until the solution was homogeneous. Each polymer was dissolved or diluted and pumped separately to the process. Glucosol™ 800 and Prosoft™ TQ1003 were prepared at about 6% solids. Redibond™ 2038A was prepared at 15% solids. The flow rates of the Glucosol™ 800, Redibond™ 2038A, and Prosoft™TQ1003 solutions were varied to deliver a total addition of 150 to 200 mg/m$^2$ spray coverage on the Yankee Dryer at the desired component ratio.

The sheet was dried to about 98-99% consistency as it traveled on the Yankee dryer and to the creping blade. The creping blade subsequently scraped the tissue sheet and a portion of the additive composition off the Yankee dryer. The creped tissue basesheet was then wound onto a core traveling at about 3600 fpm (1100 mpm) into soft rolls for converting. The resulting tissue basesheet had an air-dried basis weight of about 14.2 g/m$^2$. Two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches, and cut to facial tissue length. Tissue samples were conditioned and tested.

TABLE 2

| Sample Code | First Cationic Component (wt %) | Second Cationic Component (wt %) | Film Forming Component (wt %) | Total Add-on Rate (mg/m$^2$ of dryer surface) | Furnish Ratio EHWK:NSWK |
|---|---|---|---|---|---|
| PS1 | Redibond 2038A (20%) | Prosoft TQ1003 (20%) | Glucosol (60%) | 150 | 70:30 |
| PS2A | Redibond 2038A (20%) | Prosoft TQ1003 (20%) | Glucosol (60%) | 200 | 60:40 |
| PS2B | Redibond 2038A (20%) | Prosoft TQ1003 (20%) | Glucosol (60%) | 200 | 60:40 |

Example 2

In other instances inventive sample codes were made using a wet pressed process utilizing a Crescent Former. Initially, northern softwood kraft (NSWK) pulp was dispersed in a pulper for 30 minutes at 4% consistency at about 100° F. The NSWK pulp was then transferred to a dump chest and subsequently diluted to approximately 3% consistency. The NSWK pulp was refined at 1.5-5.0 hp-days/metric ton. The softwood fibers were used as the inner strength layer in a 3-layer tissue structure. The NSWK layer contributed approximately 34-38% of the final sheet weight. Two kilograms Kymene® 920A and 1-5 kilograms Hercobond® 1366 (Ashland, Incorporated, Covington, Ky.) per metric ton of wood fiber was added to the NSWK pulp prior to the headbox.

Aracruz ECF, a eucalyptus hardwood Kraft (EHWK) pulp (Aracruz, Rio de Janeiro, RJ, Brazil) was dispersed in a pulper for 30 minutes at about 4% consistency at about 100° F. The EHWK pulp was then transferred to a dump chest and subsequently diluted to about 3% consistency. The EHWK pulp fibers were used in the two outer layers of the 3-layered tissue structure. The EHWK layers contributed approximately 62-66% of the final sheet weight. Two kilograms Kymene® 920A per metric ton of wood fiber was added to the EHWK pulp prior to the headbox.

The pulp fibers from the machine chests were pumped to individual fan pumps which further pumped the fibers to the headbox whilst diluting the stock streams to a consistency of about 0.1%. Pulp fibers from each machine chest were sent through separate fan pumps and subsequently separate manifolds in the headbox to create a 3-layered tissue structure.

The creping compositions of Glucosol™ 800, Redibond™ 2038A, Prosoft™ TQ1003 and Polyox™ N80 that were applied to the Yankee dryer were prepared by dissolution of the solid polymers into water followed by stirring until the solution was homogeneous. Each polymer was dissolved and pumped separately to the process. Glucosol™ 800 and Prosoft™ TQ1003 were prepared at 5% solids. Polyox™ N80 was prepared at 2% solids. Redibond™ 2038A was prepared at 2-6% solids. The flow rates of the Glucosol™ 800, Redibond™ 2038A, and Prosfot™ TQ1003 or Polyox™ N80 solutions were varied to deliver a total addition of 50 to 1000 mg/m$^2$ spray coverage on the Yankee Dryer at the desired component ratio.

The sheet was dried to about 98-99% consistency as it traveled on the Yankee dryer and to the creping blade. The creping blade subsequently scraped the tissue sheet and a portion of the creping composition off the Yankee dryer. The creped tissue basesheet was then wound onto a core traveling at about 1570 to about 3925 fpm (480 mpm to 1200 mpm) into soft rolls for converting. The resulting tissue basesheet had an air-dried basis weight of about 14.2 g/m$^2$. Two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples were conditioned and tested.

TABLE 3

| Sample Code | First Cationic component (wt %) | Second Cationic Component (wt %) | Film Forming Component(s) (wt %) | Sheet Temp. (° F.) | Total Add-on Rate (mg/m$^2$ of dryer surface) |
|---|---|---|---|---|---|
| 1 | Redibond 2038 (20%) | Prosoft TQ1003 (20%) | Glucosol (60%) | 255 | 150 |
| 1 LT | Redibond 2038 (20%) | Prosoft TQ1003 (20%) | Glucosol (60%) | 230 | 150 |
| 2 | Redibond 2038 (20%) | Prosoft TQ1003 (20%) | Glucosol (60%) | 255 | 225 |
| 2 LT | Redibond 2038 (20%) | Prosoft TQ1003 (20%) | Glucosol (60%) | 230 | 225 |
| 3 LT | Redibond 2038 (20%) | Prosoft TQ1003 (20%) | Glucosol (60%) | 230 | 300 |
| 4 | Redibond 2038 (60%) | Prosoft TQ1003 (20%) | Glucosol (20%) | 255 | 150 |
| 5 | Redibond 2038 (60%) | Prosoft TQ1003 (20%) | Glucosol (20%) | 255 | 225 |
| 7 LT | Redibond 2038 (60%) | Prosoft TQ1003 (30%) | Glucosol (10%) | 230 | 150 |
| 8 | Redibond 2038 (60%) | Prosoft TQ1003 (30%) | Glucosol (10%) | 255 | 225 |
| 8 LT | Redibond 2038 (60%) | Prosoft TQ1003 (30%) | Glucosol (10%) | 230 | 225 |
| 9 | Redibond 2038 (60%) | Prosoft TQ1003 (30%) | Glucosol (10%) | 255 | 300 |

Example 3

Additional inventive and control codes were prepared according to the process illustrated in FIG. 2. Initially, northern softwood kraft (NSWK) pulp was dispersed in a pulper for 30 minutes at 1.6% consistency at about 100° F. The NSWK pulp was refined with a refiner built into the pulper for 3 to 15 minutes. The NSWK pulp was then transferred to a machine chest and subsequently diluted to approximately 0.27% consistency. The softwood fibers were used as the inner strength layer in a 3-layer tissue structure. The NSWK layer contributed approximately 30-32% of the final sheet weight. Two kilograms Kymene™ 920A (12.5% solids) per metric ton of wood fiber was added to the NSWK pulp prior to the headbox in the machine chest.

Aracruz ECF, a eucalyptus hardwood Kraft (EHWK) pulp (Aracruz, Rio de Janeiro, RJ, Brazil) was dispersed in a pulper for 30 minutes at about 1.6% consistency at about 100° F. The EHWK pulp was then transferred to a machine chest and subsequently diluted to about 0.14% consistency. The EHWK pulp fibers were used in the two outer layers of the 3-layered tissue structure. The EHWK layers contributed approximately 68-70% of the final sheet weight.

The pulp fibers from the machine chests were pumped to the headbox at a consistency of about 0.02%. Pulp fibers from each machine chest were sent through separate manifolds in the headbox to create a 3-layered tissue structure. The fibers were deposited onto a felt in a fourdrenier type of former like that shown in FIG. 2.

The wet sheet, about 10-20% consistency, was passed through the nip of a pressure roll, partially dewatering the sheet to a consistency of about 40%. The wet sheet was then adhered the Yankee dryer by spraying the creping composition onto the dryer surface using a boom situated underneath the dryer.

The creping additives were prepared by dissolution of the solid polymers into water followed by stirring until the solution was homogeneous. As described above the polymers were diluted provide the desired spray coverage on the Yankee dryer at the desired component ratio. Varying the flow rates of the polymer solutions also varies the amount of solids incorporated into the base web. The sheet was dried to about 98-99% consistency as it traveled on the Yankee dryer and to the creping blade. The creping blade subsequently scraped the tissue sheet and a portion of the creping composition off of the Yankee dryer. The creped tissue basesheet was then wound onto a core traveling at about 47 to about 52 fpm (15 mpm to 17 mpm) into soft rolls for converting. The resulting tissue basesheet had an air-dried basis weight of about 14 g/m$^2$ (gsm). The soft rolls were then rewound, calendered, and plied together so that both creped sides were on the outside of the 2-ply structure.

TABLE 4

| Sample Code | First Cationic component (wt %) | Second Cationic Component (wt %) | Film Forming Component(s) (wt %) | Other Creping Component (wt %) | Total Add-on Rate (mg/m$^2$ of dryer surface) |
|---|---|---|---|---|---|
| CHF 1 | Redibond 2038 (40%) | Prosoft TQ1003 (20%) | Glucosol (40%) | — | 150 |
| CHF 4 (Prior Art) | Redibond 2038 (100%) | — | — | — | 10 |
| CHF 5 (Prior Art) | Redibond 2038 (35%) | — | Polyvinyl Alcohol (35%) | Kymene (30%) | 10 |
| CHF 10 | Redibond 2038 (65%) | Prosoft TQ1003 (35%) | — | — | 150 |

Additional samples were also prepared using water soluble creping chemistries as previously described in US Publication No. 2010/0155004. The sample codes prepared using prior art water soluble creping chemistries are summarized below.

TABLE 5

| Sample Code | First Cationic Component | Second Cationic Component | Film Forming Component(s) | Modifier Component | Total Add-on Rate ($mg/m^2$ of dryer surface) |
|---|---|---|---|---|---|
| CHF 16 (Prior art) | — | — | Glucosol 800 (45%) and Polyox N3000 (15%) | Carbowax PEG 8000 (40%) | 150 |
| CHF 17 (Prior art) | — | — | Glucosol 800 (40%) and Polyox N3000 (15%) | Carbowax PEG 8000 (45%) | 180 |

The tissue samples prepared as described above were subjected to physical testing, the results of which are summarized in the tables below.

TABLE 6

| Sample | Basis Weight ($g/m^2$) | Caliper (μm) | GMT (gf/3") | MD Slope (kgf) | CD Slope (kgf) |
|---|---|---|---|---|---|
| PS1 | 26.9 | 235 | 783 | 7.57 | 14.21 |
| PS2A | 27.0 | 232 | 801 | 9.10 | 14.13 |
| PS2B | 27.0 | 248 | 795 | 7.72 | 14.20 |
| 1 | 27.9 | 242 | 709 | 9.85 | 15.76 |
| 1 LT | 26.6 | 221 | 811 | 9.68 | 16.42 |
| 2 | 27.6 | 234 | 628 | 10.41 | 11.42 |
| 2 LT | 27.4 | 221 | 748 | 10.19 | 13.06 |
| 3 LT | 27.6 | 238 | 744 | 8.36 | 14.13 |
| 4 | 27.6 | 237 | 678 | 11.63 | 14.69 |
| 5 | 26.7 | 226 | 698 | 7.89 | 18.60 |
| 7 LT | 26.9 | 233 | 846 | 7.61 | 17.07 |
| 8 | 25.9 | 231 | 805 | 5.32 | 18.91 |
| 8 LT | 26.2 | 233 | 741 | 5.50 | 15.56 |
| 9 | 25.5 | 234 | 818 | 4.81 | 20.89 |

TABLE 7

| Sample | Fine Crepe Structure (% COV @ 0.28-0.55) | Fuzz on Edge (PR/EL) | Water Soluble Extractives (% by weight) | Wet Out (sec.) | HST (sec.) |
|---|---|---|---|---|---|
| PS1 | 23.9 | — | — | 2.4 | 0.2 |
| PS2A | 20.1 | — | — | 2.7 | 0.2 |
| PS2B | 23.9 | — | — | 2.7 | 0.2 |
| 1 | 20.74 | 1.24 | 0.347 | 2.5 | 0.2 |
| 1 LT | 16.53 | 0.88 | 0.253 | 2.4 | 0.2 |
| 2 | 18.91 | 1.06 | 0.457 | 2.6 | 0.1 |
| 2 LT | 17.47 | 1.00 | 0.290 | 2.4 | 0.1 |
| 3 LT | 18.35 | 1.25 | 0.493 | 3.0 | 0.1 |
| 4 | 19.51 | 0.99 | 0.251 | 2.2 | 0.1 |
| 5 | 21.34 | 1.12 | 0.289 | 3.2 | 0.2 |
| 7 LT | 20.23 | 0.97 | 0.174 | 2.7 | 0.1 |
| 8 | 24.05 | 1.00 | 0.249 | 4.0 | 0.2 |
| 8 LT | 22.97 | 1.09 | 0.212 | 2.9 | 0.1 |
| 9 | 26.43 | 0.92 | 0.384 | 5.8 | 0.2 |
| CHF 1 | 16.94 | 0.80 | 0.190 | — | — |
| CHF 4 | 20.95 | 0.84 | 0.114 | — | — |
| CHF 5 | 23.04 | 0.73 | 0.115 | — | — |
| CHF 10 | 16.43 | 0.76 | 0.170 | — | — |
| CHF 16 | 18.74 | — | 0.743 | 2.4 | 0.16 |
| CHF 17 | 22.95 | — | 0.545 | — | 0.16 |

These and other modifications and variations to the present disclosure may be practiced by those of ordinary skill in the art, without departing from the spirit and scope of the present disclosure, which is more particularly set forth in the appended claims. In addition, it should be understood that the aspects of the various embodiments may be interchanged either in whole or in part. Furthermore, those of ordinary skill in the art will appreciate that the foregoing description is by way of example only, and is not intended to limit the invention further described in the appended claims.

What we claim is:

1. A creped tissue product comprising a creped tissue web having a fine crepe structure, measured as % COV at a STFI wavelength of 0.28 to 0.55 mm, less than about 20% COV, a Fuzz on Edge greater than about 0.95 mm/mm and less than about 0.60 percent water soluble extractives by weight of the tissue web.

2. The creped tissue product of claim 1 wherein the creped tissue web has a bone dry basis weight from about 24 to about 28 gsm and a bulk from about 10 to about 12 cc/g.

3. The creped tissue product of claim 1 having a Hercules Size Test (HST) value of less than about 1 second.

4. The creped tissue product of claim 1 having a Wet Out time of less than about 3 seconds.

5. The creped tissue product of claim 1 wherein the tissue product contains multiple, individual tissue sheets that are in a stacked arrangement.

6. The creped tissue product of claim 1 wherein the tissue product contains multiple tissue sheets spirally wound together, each of the tissue sheets being separated by a line of weakness.

7. The creped tissue product of claim 1 wherein the creped tissue web has from about 0.35 to about 0.60 percent water soluble extractives by weight of the tissue web.

8. The product of claim 1 wherein the creped tissue web has a fine crepe structure, measured as % COV at a STFI wavelength of 0.28 to 0.55 mm, from about 18 to about 20 percent COV, a Fuzz on Edge from about 0.95 to about 1.2 mm/mm and from about 0.2 to about 0.5 percent water soluble extractives by weight of the tissue web.

9. A creped tissue web having a first side and a second side and a creping composition comprising at least one cationic component disposed on at least the first side wherein the tissue web has a fine crepe structure, measured as % COV at a STFI wavelength of 0.28 to 0.55 mm, less than about 25 percent COV, a Fuzz on Edge greater than about 0.90 mm/mm and less than about 1.0 percent water soluble extractives by weight of the tissue web.

10. The creped tissue web of claim 9 wherein the creping composition is water soluble.

11. The creped tissue web of claim 9 wherein the at least one cationic component comprises an amphoteric starch or a cationic starch having a charge density of at least about 0.1 mEq/g.

12. The creped tissue web of claim 9 wherein the at least one cationic component comprises a quaternary ammonium salt having the general formula:

$$(R^{1'})_{4-b}—N^{+}—(R^{1''})_{b}X^{-}$$

wherein $R^{1'}$ is a $C_{1-6}$ alkyl group, $R^{1''}$ is a $C_{14-22}$ alkyl group, b is an integer from 1 to 3 and $X^{-}$ is any suitable counterion.

13. The creped tissue web of claim 9 wherein the at least one cationic component comprises a cationic oleyl imidazoline.

14. The creped tissue web of claim 9 wherein the creping composition further comprises a film forming component selected from the group consisting of hydroxylpropyl modified starch, poly(ethylene) oxide, cellulose ethers and esters, and poly(acrylate esters).

15. The creped tissue web of claim 9 wherein the creping composition further comprises an adhesive component selected from the group consisting of polyethylene glycols, amine terminated ethylene glycols, and ethylene glycol-propylene glycol block copolymers.

16. The creped tissue web of claim 9 wherein the creping composition comprises at least two different cationic components and a film forming component disposed on at least the first side.

17. The creped tissue web of claim 16 wherein the first cationic component is a cationic starch, the second cationic polymer has the general formula:

$$(R^{1'})_{4-b}—N^{+}—(R^{1''})_{b}X^{-}$$

wherein $R^{1'}$ is a $C_{1-6}$ alkyl group, $R^{1''}$ is a $C_{14-22}$ alkyl group, b is an integer from 1 to 3 and $X^{-}$ is any suitable counterion; and the film forming component is selected from the group consisting of hydroxylpropyl modified starch, poly(ethylene) oxide, cellulose ethers and esters, and poly(acrylate esters).

* * * * *